US010995294B2

(12) United States Patent
Duffy

(10) Patent No.: US 10,995,294 B2
(45) Date of Patent: May 4, 2021

(54) CHARGED BLOCK CO-POLYMERS AS POUR POINT DEPRESSANTS

(71) Applicant: Baker Hughes, a GE company, LLC, Houston, TX (US)

(72) Inventor: Richard Duffy, Sugar Land, TX (US)

(73) Assignee: Baker Hughes Holdings LLC, Houston, TX (US)

( * ) Notice: Subject to any disclaimer, the term of this patent is extended or adjusted under 35 U.S.C. 154(b) by 0 days.

(21) Appl. No.: 16/793,718

(22) Filed: Feb. 18, 2020

(65) Prior Publication Data

US 2020/0181518 A1 Jun. 11, 2020

Related U.S. Application Data

(63) Continuation of application No. 13/919,671, filed on Jun. 17, 2013, now abandoned.

(60) Provisional application No. 61/663,178, filed on Jun. 22, 2012.

(51) Int. Cl.

| | |
|---|---|
| ***C10L 10/16*** | (2006.01) |
| ***C10L 10/18*** | (2006.01) |
| ***C10M 145/14*** | (2006.01) |
| ***C10L 1/196*** | (2006.01) |
| *C10N 30/04* | (2006.01) |

(52) U.S. Cl.

CPC ..... *C10L 10/16* (2013.01); *C10L 1/1963* (2013.01); *C10L 10/18* (2013.01); *C10M 145/14* (2013.01); *C10M 2209/084* (2013.01); *C10M 2221/02* (2013.01); *C10N 2030/04* (2013.01)

(58) Field of Classification Search

CPC combination set(s) only.

See application file for complete search history.

(56) References Cited

U.S. PATENT DOCUMENTS

| | | | | |
|---|---|---|---|---|
| 4,156,434 | A * | 5/1979 | Parker | C10L 1/143 137/13 |
| 4,650,596 | A | 3/1987 | Schlueter et al. | |
| 5,281,329 | A * | 1/1994 | Mueller | C10L 1/1963 137/13 |
| 5,743,923 | A | 4/1998 | Davies et al. | |
| 6,218,490 | B1 | 4/2001 | Brunelli et al. | |
| 6,255,261 | B1 | 7/2001 | Liesen et al. | |
| 7,790,821 | B2 | 9/2010 | Baloche et al. | |
| 2009/0247428 | A1 | 10/2009 | Duncum et al. | |
| 2010/0311920 | A1* | 12/2010 | Gonzalez Montiel | C08L 69/00 525/92 E |
| 2011/0033532 | A1 | 2/2011 | Angel et al. | |

OTHER PUBLICATIONS

Mahmoud, SA, et al., "Studies on the Influence of Cationic Surfactant Chemical Additives on Wax Deposition", Petroleum Science and Technology, 2006, 24(9), 1115-1124.

* cited by examiner

*Primary Examiner* — Ellen M McAvoy
*Assistant Examiner* — Chantel L Graham
(74) *Attorney, Agent, or Firm* — Mossman, Kumar & Tyler, P.C.

(57) ABSTRACT

Fouling components within a fluid may be prevented from accumulating when an additive contacts the fluid, e.g. by coating the wellbore with the additive prior to the production of the fluid or adding the additive directly to the fluid, etc.. The additive may include, but is not limited to, a block copolymer having at least two components. The first component may be a charged monomer, and the second component may be a long chain fatty alcohol acrylate monomer. In one alternative embodiment, the fluid may be an oil-based fluid produced through a wellbore or an oil-based wellbore fluid, and the fouling components may be or include, but are not limited to, wax, paraffins, asphaltene, resins, and combinations thereof.

17 Claims, No Drawings

CHARGED BLOCK CO-POLYMERS AS POUR POINT DEPRESSANTS

CROSS-REFERENCE TO RELATED APPLICATION

This application is a Continuation Application and claims priority to U.S. application Ser. No. 13/919,671 filed Jun. 17, 2013, which claims the benefit of U.S. Provisional Patent Application No. 61/663,178 filed Jun. 22, 2012, both of which are incorporated by reference herein in their entirety

TECHNICAL FIELD

The present invention relates to at least partially reducing an accumulation of at least one fouling component within a fluid by adding an additive to the fluid, and more particularly relates in one non-limiting embodiment to preventing waxes, paraffins, and combinations thereof within the fluid from agglomerating or precipitating within the fluid.

BACKGROUND

Fuel oils, crude oils, refinery fluids, lubricants and/or petroleum products may often contain fouling components, e.g., paraffins, waxes, etc. that may agglomerate or precipitate, particularly at low temperatures, as large crystals in such a way that may cause the oil to lose its ability to flow, i.e. the pour point becomes higher because of the fouling components within the fluid. The 'pour point' of a fluid is the temperature at which a fluid ceases to pour. One test to determine the pour point is the ASTM D-97 pour point test where the oil ceases to flow at a given temperature (the pour point) when the sample is held at 90 degrees to the upright for five seconds. Higher pour points are typically associated with crude oils having significant paraffin or wax content because these fouling components begin precipitating as the temperature of the fluid decreases. At some point, the precipitates may accumulate and/or agglomerate to the point where the fluid will no longer flow. 'Fouling component' is defined herein to be any component that may agglomerate or precipitate in a fluid.

As the temperature of the fluid falls and approaches the pour point, difficulties arise in transporting the fuel or lubricant through lines and pumps. Further, the wax crystals tend to plug fuel lines, screens, and filters at temperatures above the pour point. These problems are well recognized in the art, and various additives have been proposed, many of which are in commercial use, for depressing the pour point of fuel oils and lubricants. Similarly, other additives have been proposed and are in commercial use for reducing the size and changing the shape of the wax crystals that do form. Smaller size crystals are desirable since they are less likely to clog a filter, but these smaller crystals may still agglomerate and form larger crystals and subsequently pose the same problem of plugging or clogging various types of well equipment. Thus, it would be beneficial to also prevent the smaller crystals from agglomerating and/or precipitating, or otherwise accumulating.

Such well treatment agents may be placed in contact with the oilfield fluids contained in the formation before such fluids enter the wellbore where deleterious effects are commonly encountered. Various well treatment agents are often used in production wells to prevent the deleterious effects caused by such formations and precipitates. For instance, pour point depressants and wax crystal modifiers have been used to change the nature of wax crystals that precipitate from the petroleum fuel, lubricant or crude oil, thereby reducing the tendency of wax crystals to plug equipment It would be desirable if the aforementioned fluid compositions and methods for using such fluids could be tailored to prevent the agglomerating and/or precipitating of these types of fouling components within the fluid, and thereby reduce the pour point of the fluid.

SUMMARY

There is provided, in one form, a method for contacting a fluid having wax, paraffins, and/or asphaltene that is a crude oil, a refinery fluid, a lubricant, and/or a fuel oil with an additive in an effective amount for at least partially reducing an accumulation of the fouling component(s). The additive may include, but is not limited to a block copolymer having at least two components. The first component may be a charged monomer, and the second component may be a long chain fatty alcohol acrylate monomer. The first component may be or include, but is not limited to a cationic acrylate based monomer, a salt of acrylic acid, a salt of methacrylic acid, a salt of carboxyethyl acrylate, a salt of carboxyethyl methacrylate, a sulfonated styrene, a cationic styrene derivative, an ester derived from a cationic terminated alcohol, an ester derived from a carboxylate terminated alcohol, a derivative formed from alkylation with a cationic terminated epoxide, a derivative formed from alkylation with an anionic terminated epoxides, and combinations thereof; wherein the charged monomer reduces the amount of agglomeration or precipitation of paraffin, wax, and/or asphaltene crystals in the crude oil, a lubricant, a refinery fluid, and/or fuel oil.

In an alternative non-limiting embodiment of the method, the fouling component may be or include, but is not limited to wax, paraffins, asphaltene, resins, and combinations thereof and the fluid is an oil-based wellbore fluid.

There is provided in another form, a fluid composition having an oil-based fluid produced through a wellbore and an additive. The additive may include, but is not limited to, a block copolymer having at least two components. The first component may be a charged monomer of the kinds recited in paragraph [0007], and the second component may be a long chain fatty alcohol acrylate monomer; wherein the charged monomer reduces the amount of agglomeration or precipitation of crystals of the at least one fouling component in the oil-based fluid.

In an alternative non-limiting embodiment of the fluid composition, the fluid may be an oil-based wellbore fluid and the fouling component may be present in the fluid in amount ranging from 2.5 wt % to about 20 wt %.

DETAILED DESCRIPTION

It has been discovered that an additive having a block copolymer with a charged monomer may act as a pour point depressant and/or at least partially reduce the accumulation of at least one fouling component within a fluid by contacting the fluid with the additive. The additive may be circulated within the wellbore prior to production of the fluid, so that the additive may contact the fluid upon production of the fluid into the wellbore. The additive may also be added directly to the hydrocarbon fluid in an amount that may at least partially reduce the fouling components therein from accumulating. 'Accumulation' is defined herein to mean agglomeration and/or precipitation of the fouling components.

Utilizing block copolymerization may allow for better synthesis of acrylate polymers with well defined blocks, and allows monomers of varying uses to be combined into a multi-use copolymer. Here, the block copolymer may have at least two components. The second component may act as a crystal modifier to reduce further growth of wax crystals and keep the size of the wax crystals smaller than they might otherwise have been. However, smaller crystals may still remain within the fluid, and these smaller crystals may agglomerate and/or precipitate to form larger crystal structures that may still cause an increased pour point and/or clogging of well equipment.

By including a charged monomer (hereinafter referred to as the 'first component') in the block copolymer, the smaller crystals may be prevented or blocked from agglomerating and/or precipitating within the fluid. A block copolymer having this type of functionality may prevent wax crystals from clogging well equipment and allows for the pour point of the fluid to remain stable, if not lower the pour point, compared to what would otherwise occur if the additive comprising the block copolymer had not contacted the fluid. Thus the copolymer additives herein are more accurately characterized as pour point stabilizers rather than pour point depressants. In a non-limiting embodiment, the fluid may be a hydrocarbon fluid, such as crude oil, a refinery fluid, a lubricant, a fuel oil, and combinations thereof. 'Refinery fluid' is defined herein to be a hydrocarbon fluid that is ready to be refined or is in the process of being refined.

"Reduce" is defined herein to mean that the additive may suppress, inhibit or prevent the amount of accumulation of the fouling components within the fluid if there are actually any fouling components present within the fluid. That is, it is not necessary for the fouling components to be entirely prevented or diminished from accumulating for the methods and compositions discussed herein to be considered effective, although complete prevention is a desirable goal.

The first component may be or include, but is not limited to a charged monomer, either a cationic monomer or an anionic monomer, such as but not limited to, a cationic acrylate based monomer, an anionic acrylate based monomer, a sulfonated styrene, a cationic styrene derivative, an ester derived from a cationic terminated alcohol, an ester derived from a carboxylate terminated alcohol, a derivative formed from alkylation with a cationic terminated epoxide, a derivative formed from alkylation with an anionic terminated epoxide, and combinations thereof. More specific non-limiting examples of the cationic acrylate based monomer may be or include, but are not limited to, acryloxyethyltrimethylammonium chloride, methacryloxyethyltrimethylammonium chloride, acryloxypropyltrimethylammonium chloride, methacryloxypropyltri-methylammonium chloride, corresponding methylsulfate or sulfate salts thereof, and combinations thereof. More specific non-limiting examples of the anionic acrylate based monomer may be or include, but are not limited to salts of acrylic acid, methacrylic acid, carboxyethyl acrylate, and carboxyethyl methacrylate. The first component may have a carbon chain ranging from about 2 carbon atoms independently to about 8 carbon atoms, alternatively from about 2 carbon atoms independently to about 6 carbon atoms in another non-limiting embodiment. As used herein with respect to a range, "independently" means that any lower threshold may be used together with any upper threshold to give a suitable alternative range.

The second component may be or include, but is not limited to a long chain fatty alcohol acrylate monomer. Other non-limiting examples of the fatty alcohol acrylate monomer may be or include an octadecyl acrylate, a $C_{20}$ acrylate, a $C_{30}$ acrylate, and combinations thereof. The second component may have a carbon chain ranging from about 10 carbon atoms independently to about 40 carbon atoms, alternatively from about 18 carbon atoms independently to about 30 carbon atoms, or from about 18 carbon atoms independently to about 25 carbon atoms in another non-limiting embodiment.

By definition, herein, the second component is different from the first component. Moreover, 'first component' and 'second component' are used as generic identifiers for at least two of the components within the block copolymer. These terms are not used to specify any type of order or layout of the components within the block copolymer.

In one non-limiting embodiment, the amount of the first component within the block copolymer may range from about 1 wt % independently to about 20 wt % of the total block copolymer, alternatively from about 2 wt % independently to about 10 wt %, or from about 2 wt % independently to about 5 wt % in another non-limiting embodiment. The amount of the second component within the block copolymer may range from about 80 wt % independently to about 99 wt % of the total block copolymer, alternatively from about 90 wt % independently to about 98 wt %, or from about 92 wt % independently to about 95 wt % in another non-limiting embodiment.

The additive may optionally include an aromatic solvent, such as but not limited to, benzene, toluene, xylene, or at least one distillate such as aromatic 100 in a non-limiting embodiment, and combinations thereof. The amount of the block copolymer within the additive may range from about 15 wt % independently to about 50 wt %, or alternatively from about 20 wt % independently to about 40 wt %, or from about 20 wt % independently to about 30 wt % in another non-limiting embodiment.

The block copolymer may be prepared by a polymerization method, such as but not limited to, the living free radical polymerization, which may also be referred to as "reversible-deactivation radical polymerization", and/or "controlled radical polymerization". This type of polymerization may mediate the polymerization via a reversible chain-transfer process and may have an active polymer chain end with a free radical. Atom Transfer Radical Polymerization (ATRP) and Reversible Addition-Fragmentation Chain-Transfer Polymerization (RAFT) are two types of living free radical polymerization that may be relevant to preparing the type of block copolymers described.

Atom transfer radical polymerization (ATRP) is a means of forming a carbon-carbon bond through a transition metal catalyst. The transition metal catalyst may allow for a uniform polymer chain growth. There may be or include several important components for producing Atom Transfer Radical Polymerizations, such as but not limited to, a monomer, an initiator, a catalyst, a solvent, a ligand and temperature. Here, the initiator may be or include, but is not limited to, ethyl bromoisobutyrate, methyl bromoisobutyrate, ethyl 2-bromopropionate, methyl 2-bromopropionate, 2-bromopropionitrile, and combinations thereof. The catalyst may be or include, but is not limited to, zero valent copper; copper (I) salts, such as halides, oxides, or acetates; copper (II) salts, such as halides, acetates; and combinations thereof. The catalyst may be or include, but is not limited to, copper, nickel, iron, ruthenium, cobalt, rhenium, rhodium, molybdenum and combinations thereof. The ligands may include, but are not limited to, tetramethyl ethylene diamine, pentamethyl ethylene triamine, and hexamethyl ethylene tetramine. Typical solvents may include, but are not limited to, toluene; 1,4-dioxane; xylene; anisole; DMF; DMSO; water; methanol; ACN; chloroform; bulk monomer; and combinations thereof.

RAFT polymerization also uses a chain transfer agent in the form of a thiocarbonylthio compound to afford control over the generated molecular weight and polydispersity during a free-radical polymerization. As with other controlled radical polymerization techniques, RAFT polymerizations may be performed with conditions to favor low polydispersity indices and a pre-chosen molecular weight. The components for a RAFT polymerization may be or include, but are not limited to, a radical source (e.g. thermochemical initiator or the interaction of gamma radiation with some reagent), monomer, a chain transfer agent, a solvent, and combinations thereof. The radical source may be or include, but is not limited to, azo compounds such as Azobisisobutyronitrile (AIBN); peroxides such as benzoyl peroxide, hydroperoxides such as t-butylhydroperoxide; and combinations thereof. The chain transfer agent may be or include, but is not limited to dithiobenzoates, trithiocarbonates, dithiocarbamates, and combinations thereof. The solvent may be or include, but is not limited to toluene, xylenes, or a distillate such as aromatic 100 in a non-limiting embodiment, and combinations thereof.

The additive may further include an additional component that may impart other properties to the additive or the fluid. For example, the additive may include an additional component, such as but not limited to, a cold flow improver, a scale inhibitor, a corrosion inhibitor, a bactericide, and combinations thereof, so long as the ingredient does not de-stabilize or break the dispersion of the block copolymer within the fluid.

The additive may be added to the fluid by a method, such as but not limited to, injecting and/or spraying the additive into the fluid, wellbore, and combinations thereof. The additive may contact the fluid in an effective amount to at least partially reduce the accumulation of the fouling components therein as compared to an otherwise identical fluid absent the additive. Alternatively, the amount of the additive within the fluid may range from about 100 ppm independently to about 10,000 ppm, or alternatively from about 200 ppm independently to about 5,000 ppm, or from about 500 ppm independently to about 4,000 ppm in another non-limiting embodiment.

The additive may be useful in crude oil, lubricants, refinery fluids, and/or fuel oils having a fouling component content ranging from about 7.5 wt % independently to about 20 wt %, alternatively from about from about 2.5 wt % independently to about 7.5 wt %, or from about 0.5 wt % independently to about 2.5 wt % in another non-limiting embodiment. The additive may target fouling components in size ranging from about 6 carbon atoms independently to about 200 carbon atoms, alternatively from about 10 carbon atoms independently to about 150 carbon atoms, or from about 18 carbon atoms independently to about 100 carbon atoms in another non-limiting embodiment. The additive may function within the fluid when the temperature of the fluid ranges from about −40 C independently to about 50 C, alternatively from about −20 C independently to about 40C, or from about −10 C independently to about 35 C in another non-limiting embodiment.

The additive may also include a dispersant, which is typically one or more surfactants (or co-surfactants), used for dispersing and/or emulsifying the additive into the fluid. The dispersant may improve the separation of particles and may prevent settling or clumping of the additive once it contacts and subsequently mixes with the fluid. Such dispersants may be or include, but are not limited to ethoxylated alcohols, alkyl phenols, and combinations thereof.

The resulting additive may include the dispersant and the block copolymer. For dispersions intended to be used to treat hydrocarbon/water mixtures, the dispersion may have a density between that of water and the fluid being treated to allow the additive to locate at the interface between the water and the hydrocarbon within the fluid. For example, the density may be less than 1 gm/cm$^3$ and greater than the hydrocarbon or hydrocarbon-derived fluid. In one non-limiting example, if the liquid is crude oil, which has a density from about 0.75 gm/cm$^3$ to about 0.96 gm/cm$^3$, the density of the dispersion should be between at least about 0.75 gm/cm$^3$ and about 1 gm/cm$^3$, depending on the density of the actual crude oil being treated, but more typically from about 0.85 gm/cm$^3$ to about 1 gm/cm$^3$, depending on the density of the particular crude oil.

In the foregoing specification, the invention has been described with reference to specific embodiments thereof, and has been described as effective in providing methods for preventing an accumulation of at least one fouling component within a fluid, such as but not limited to, wax, paraffins, asphaltene, resins, and combinations thereof within a hydrocarbon fluid. However, it will be evident that various modifications and changes can be made thereto without departing from the broader spirit or scope of the invention as set forth in the appended claims. Accordingly, the specification is to be regarded in an illustrative rather than a restrictive sense. For example, specific fluids, fouling components, additive components, monomers, and block copolymers falling within the claimed parameters, but not specifically identified or tried in a particular composition or method, are expected to be within the scope of this invention.

The present invention may suitably comprise, consist or consist essentially of the elements disclosed and may be practiced in the absence of an element not disclosed. For instance, the method may consist of or consist essentially of a method of contacting a fluid having at least one fouling component with an additive in an effective amount for at least partially reducing an accumulation of the fouling component(s) as compared to an otherwise identical fluid absent the additive where the additive includes at least two components, such as a charged monomer, and a long chain fatty alcohol acrylate monomer.

There is additionally provided a fluid composition having an oil-based fluid an additive where the includes at least two components, such as a charged monomer, and a long chain fatty alcohol acrylate monomer, and where the fluid composition has a reduced accumulation of at least one fouling component as compared to an otherwise identical fluid composition absent the additive.

The words "comprising" and "comprises" as used throughout the claims, are to be interpreted to mean "including but not limited to" and "includes but not limited to", respectively.

What is claimed is:

1. A method comprising:

contacting an oil-based fluid comprising a paraffin, wax, and/or an asphaltene selected from a group consisting of crude oil, a lubricant, a refinery fluid, fuel oil, and combinations thereof with an additive in an effective amount for at least partially reducing an accumulation of the paraffin, wax, and/or asphaltene as compared to an otherwise identical fluid absent the additive; wherein the additive comprises a block copolymer comprising at least a first component and a second component; wherein the first component is a charged monomer, and the second component is a long chain fatty alcohol acrylate monomer, wherein the charged monomer is selected from the group consisting of a salt of acrylic acid, a salt of methacrylic acid, a salt of carboxyethyl acrylate, a salt of carboxyethyl methacrylate, a sulfonated styrene, a cationic styrene derivative, a derivative formed from alkylation with a cationic terminated epoxide, a derivative formed from alkylation with an anionic terminated epoxides, and combinations thereof; and wherein the block copolymer reduces the amount of agglomeration or precipitation of paraffin, wax, and/or asphaltene crystals in the crude oil, a lubricant, a refinery fluid, and/or fuel oil.

2. The method of claim 1, wherein the oil-based fluid is selected from the group consisting of a crude oil, a refinery fluid, a lubricant, a fuel oil, and combinations thereof.

3. The method of claim 1, wherein the additive comprises from about 15 wt % to about 50 wt % of the block copolymer.

4. The method of claim 1, wherein the block copolymer comprises from about 1 wt % to about 20 wt % of the first component.

5. The method of claim 1, wherein the effective amount of the additive ranges from about 100 ppm to about 10,000 ppm based on the fluid.

6. The method of claim 1, wherein the additive further comprises an aromatic solvent selected from the group consisting of benzene, toluene, xylene, a distillate, and combinations thereof.

7. A method comprising:

contacting an oil-based wellbore fluid having at least one fouling component with an additive in an effective amount for at least partially reducing an accumulation of the at least one fouling component within the oil-based wellbore fluid as compared to an otherwise identical hydrocarbon fluid absent the additive; wherein the at least one fouling component is selected from the group consisting of wax, paraffins, asphaltene, resins, and combinations thereof; wherein the additive comprises a block copolymer comprising at least a first component and a second component;

wherein the first component is a charged monomer selected from the group consisting of an anionic acrylate based monomer, a sulfonated styrene, a cationic styrene derivative, a derivative formed from alkylation with a cationic terminated epoxide, a derivative formed from alkylation with an anionic terminated epoxides, and combinations thereof; and wherein the block copolymer reduces the amount of agglomeration or precipitation of crystals of the at least one fouling component in the oil-based wellbore fluid.

8. The method of claim 7, wherein the additive comprises about 15 wt % to about 50 wt % of the block copolymer.

9. The method of claim 7, wherein the effective amount of the additive ranges from about 100 ppm to about 10,000 ppm based on the fluid.

10. A fluid composition comprising:

an oil-based fluid produced through a wellbore;

at least one fouling component;

an additive comprising a block copolymer having a long chain fatty acid acrylate monomer and a charged monomer, wherein the charged monomer is selected from the group consisting of a salt of acrylic acid, a salt of methacrylic acid, a salt of carboxyethyl acrylate, a salt of carboxyethyl methacrylate, a sulfonated styrene, a cationic styrene derivative, a derivative formed from alkylation with a cationic terminated epoxide, a derivative formed from alkylation with an anionic terminated epoxides, and combinations thereof; and wherein the block copolymer reduces the amount of agglomeration or precipitation of crystals of the at least one fouling component in the oil-based fluid.

11. The fluid composition of claim 10, wherein the block copolymer comprises from about 1 wt % to about 20 wt % of the charged monomer.

12. The fluid composition of claim 10, wherein the amount of the additive within the oil-based fluid ranges from about 100 ppm to about 10,000 ppm.

13. The fluid composition of claim 10, wherein the additive further comprises an aromatic solvent selected from the group consisting of benzene, toluene, xylene, a distillate, and combinations thereof.

14. The fluid composition of claim 10, wherein the oil-based fluid is selected from the group consisting of a crude oil, a refinery fluid, a lubricant, a fuel oil, and combinations thereof.

15. The fluid composition of claim 10, wherein the at least one fouling component is selected from the group consisting of paraffin, wax, asphaltene, resins, and combinations thereof.

16. A fluid composition comprising:

an oil-based wellbore fluid;

at least one fouling component present in the fluid in amount ranging from 0.5 wt % to about 20 wt %;

an additive comprising a block copolymer having a long chain fatty acid acrylate monomer and a charged monomer selected from the group consisting of an anionic acrylate based monomer, a sulfonated styrene, a cationic styrene derivative, a derivative formed from alkylation with a cationic terminated epoxide, a derivative formed from alkylation with an anionic terminated epoxides, and combinations thereof; and wherein the block copolymer reduces the amount of agglomeration or precipitation of crystals of the at least one fouling component in the oil-based wellbore fluid.

17. The fluid composition of claim 16, wherein the amount of the additive within the oil-based fluid ranges from about 100 ppm to about 10,000 ppm.

* * * * *